United States Patent [19]

Fulton

[11] 4,405,196

[45] Sep. 20, 1983

[54] ELECTRICAL CONNECTOR FOR HIGH FIDELITY AUDIO EQUIPMENT

[76] Inventor: Robert W. Fulton, 4428 Zane Ave. North, Minneapolis, Minn. 55422

[21] Appl. No.: 224,083

[22] Filed: Jan. 12, 1981

[51] Int. Cl.[3] ..... H01R 11/04

[52] U.S. Cl. ..... 339/273 F

[58] Field of Search ..... 339/94 A, 130 R, 130 C, 339/263 R, 263 L, 269, 271, 273 R, 273 F, 270 R

[56] References Cited

U.S. PATENT DOCUMENTS

| | | | |
|---|---|---|---|
| 1,284,424 | 11/1918 | Morrison | 339/94 A |
| 1,932,456 | 10/1933 | Gaston | 339/94 A |
| 2,379,439 | 7/1945 | Hotine | 339/270 R |
| 2,988,723 | 6/1961 | Archer | 339/273 R |
| 3,564,118 | 2/1971 | Becker | 339/270 R |

FOREIGN PATENT DOCUMENTS

| | | | |
|---|---|---|---|
| 1518847 | 2/1968 | France | 339/263 R |

*Primary Examiner*—Joseph H. McGlynn

*Attorney, Agent, or Firm*—Orrin M. Haugen; Thomas J. Nikolai

[57] ABSTRACT

A two-piece, separable electrical connector adapted to couple mating parts of the various components used in high fidelity stereo equipment or the like. The first element comprises a male plug member formed from a block of conductive material and having a generally tapered frusto conical portion extending from one end of a cylindrical segment having opposed flat surfaces formed thereon. A threaded bore is formed axially through this cylindrical member so as to receive a bolt, the bolt being used to secure an electrical cable to the connector member. The second element of the connector is a female member comprising a generally cylindrical conductive piece having a longitudinal, smoothly tapered bore extending inwardly from one end surface thereof. Formed in the opposite end surface is a threaded bore which, too, is arranged to receive a bolt for attaching an electrical conductor to the female element. The two elements may be joined by inserting the frusto conical portion of the first element into the tapered bore of the second element. Means are also provided on the female element for insulatively mounting the female element in an aperture formed through a chassis wall.

5 Claims, 2 Drawing Figures

FIG. 1
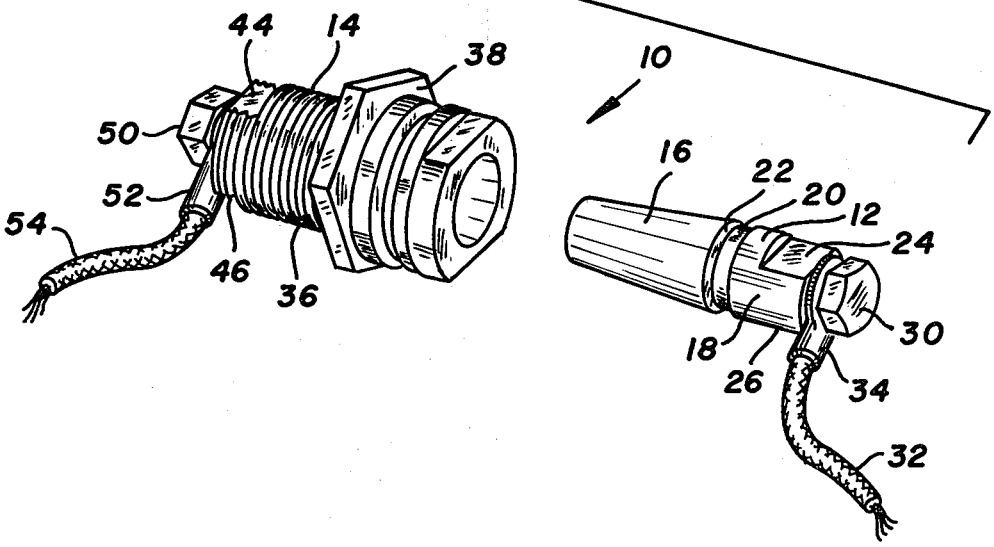
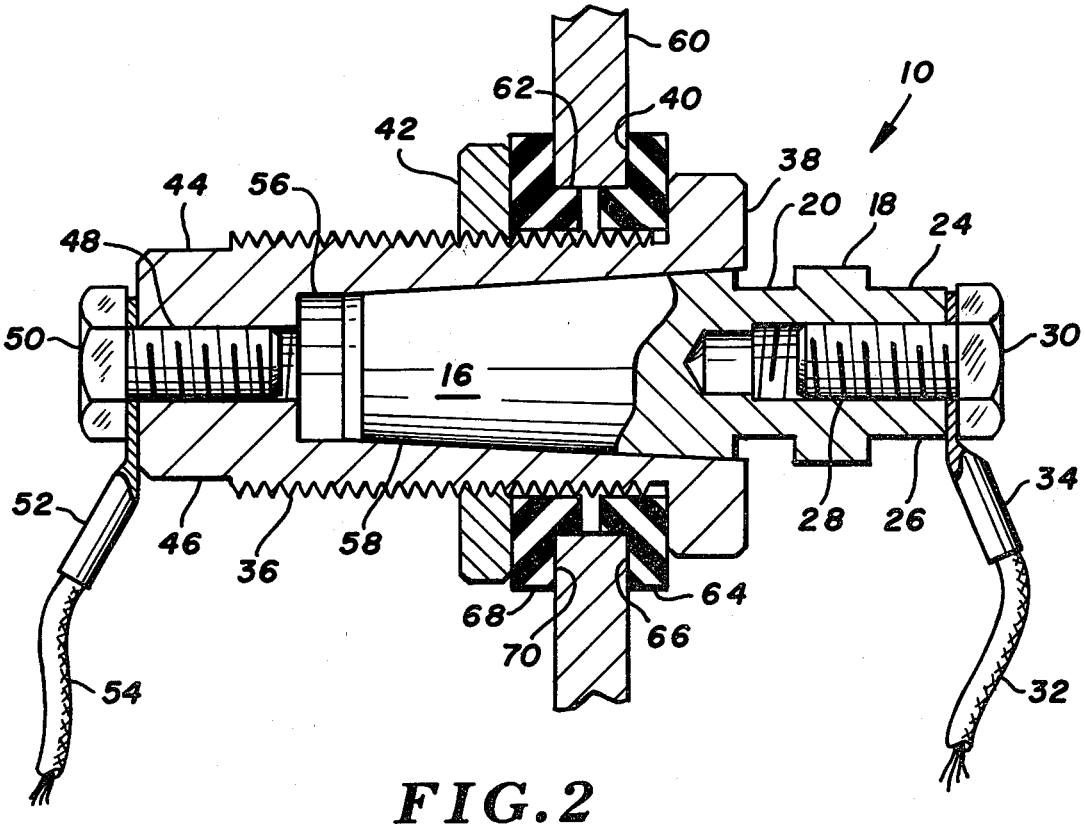
FIG. 2

ELECTRICAL CONNECTOR FOR HIGH FIDELITY AUDIO EQUIPMENT

BACKGROUND OF THE INVENTION

1. Field of the Invention

This invention relates generally to electrical connectors, and more specifically to the particular design of an electrical connector intended for use with high fidelity audio equipment whereby the sound quality of the system is markedly improved.

2. Discussion of the Prior Art

Until the present invention, there has not been an adequately designed connector for interfacing an audio system's components e.g., amplifier, speaker cable and speaker. The well-known banana plug, currently used in most amplifier and speaker systems is considered to be a "hand-me-down" from early radio and electronic instrumentation such as volt meters, oscilliscopes, etc. where the load impedances were generally in excess of 600 ohms and where the current encountered seldom exceeded a few milliamperes. The present day demands of high quality audio playback far exceed the capabilities of the banana plug as an acceptable connector.

By way of further explanation, present day high performance audio equipment commonly generate up to 80 volts of very complex, multifaceted waveforms, with 60 ampere peak currents not being uncommon. Rather than working into a 600 ohm impedance, high performance audio amplifiers generally interface with speakers exhibiting a 2 to 8 ohm load. The prior art banana plug generally comprises a plurality of thin, bowed tines of semi-tempered copper or brass plated with nickel (a relatively poor conductor). Thus, when mated in a cylindrical socket, the contact area between the bowed tines and the inner wall of the socket is quite small and subject to vibration. As the music or other audio programming material is passed through such a connector, the banana plug effectively becomes an active oscillator producing indiscriminate spectral energy variations.

Then too, the conventionally used banana plug is subject to oxidation and fatigue with continued use such that losses introduced by such a connector often vary from a few millivolts up to several volts. Frequency analysis of the noise produced by such faulty connectors shows that it is rich in frequency components well within the response characteristics of the human ear, typically anywhere from 150 Hz up to 5,000 Hz. This, of course, adversely effects the fidelity of the sound in that there is a drastic loss of definition and clarity. The vibrating tines of the banana plug, in effect, pulse amplitude modulates the audio signal delivered to the speaker load.

It is further found that banana plug type connectors of the prior art introduce up to a 35% loss. It is found to distort proper vowel structures and adds a graininess all its own to the amplified audio output. When analyzed with an oscilliscope connected directly across the banana plug as a large orchestral piece is being played, the noise components introduced by the vibration of the tines of the banana plug can be observed.

The defects encountered with banana plug-type electrical connectors may also be found in alternative arrangements commonly used for coupling the components of a high fidelity stereo sound system together. Fhanstock clips and the like are also seen to introduce losses and noise at a noticeable and objectionable level.

SUMMARY OF THE INVENTION

The present invention has been found to obviate the above-described draw-backs of conventional, prior art connectors commonly used with high fidelity sound equipment. The connector itself comprises a rather massive, two-piece device including a male member and a female member wherein the male member is provided with a frusto conical portion intended to mate in an interference-fit fashion with a correspondingly tapered bore formed in the female connector member. Attention is paid to proper dimensioning so that sufficient surface contact is provided for essentially zero resistance mating. Because of the high mass of the connector parts employed, when the mating parts are joined they cannot vibrate or chatter like the thin, flexible tines of the prior art banana plug. Furthermore, the design of the connector of the present invention, being somewhat massive, permits heavier gauge conductors to be used in, say, joining the amplifier output to the associated loudspeakers, thus eliminating excessive losses in the conductors themselves. Again, because of its mass, the connector arrangement of the present invention has no audible resonances, it is not frequency-selective and is capable of handling kilowatts of power from DC to frequencies well beyond the audio spectrum.

Electrical connectors having a tapered pin insertable within a tapered socket are not new, per se. (See the Jackson U.S. Pat. No. 2,308,811.) However, in the preferred embodiment described herein, attention is paid to proper relationships between connector mass, contact area, and tolerances so that vastly and surprisingly improved audio performance is realized.

OBJECTS

It is accordingly the principal object of the present invention to provide a new and improved connector structure for use in joining components of high fidelity audio systems, one to the other.

Another object of the invention is to provide an improved electrical connector which provides a relatively large contact surface for zero-loss coupling of electrical signals.

A still further object of the invention is to provide an electrical connector for use in audio systems wherein, because of the sizing of the connector parts, no noise components can be introduced due to vibrational feedback.

Still another important object of this invention, is to provide a total connector configuration that will improve its conductivity with use, rather than suffering degradation, in that the fit becomes tighter with repeated use because of small micro-tool marks burnished off and the plating conforms to a greater degree for higher conductivity.

These and other objects and advantages of the invention will become apparent to those skilled in the art from the following detailed description of a preferred embodiment when taken in conjunction with the following drawings in which like numerals in the different figures refer to corresponding parts.

DESCRIPTION OF THE DRAWINGS

FIG. 1 is a perspective view of the connector with the mating parts separated; and FIG. 2 is a cross-sectional view with the separable parts mated.

DESCRIPTION OF THE PREFERRED EMBODIMENT

Referring first to FIG. 1, the connector of the present invention is identified generally by numeral 10 and is seen to include a male member 12 and a female member 14. Referring first to the male member, it is preferably formed from a high density solid copper and includes a tapered or frusto conically shaped portion 16 joined to a generally cylindrical portion 18 by a cylindrical segment 20 of a lesser diameter than the major base 22 of the frusto conical portion 16 and also less than the diameter of the cylindrical portion 18. Formed on the surface of the cylindrical portion 18 are diametrically opposed flat portions 24 and 26, the purpose of which will be later explained. Extending inwardly from the end edge surface of the cylindrical portion 18 is a bore 28 (FIG. 2) which is internally threaded so as to receive a bolt member 30 therein. The bolt 30 is used to fasten an electrical conductor 32 to the male portion 12 of the connector 10, it being found convenient to have the conductor 32 terminated with a lug 34 having a aperture therethrough for receiving the threaded shank portion of the bolt 30. When the bolt 30 is tightened down, the lug 34 is squeezed firmly against the end edge portion of the male connector portion 12, thus assuring good electrical contact. Alternatively, by providing a threaded bore (not shown) radially through the flat 24 and into the longitudinal bore, an allen head screw may be used to tightly hold a bare wire end on lead 32 in the longitudinal bore.

The length of the frusto conical portion 16 of the male connector part 12 may be in the range of from 1 inch to 1.5 inches in length and preferably 1.24 inches in length and may taper from a diameter of from about 0.7 inches at its base end 22 down to a diameter of 0.4 inches at its smaller end, 0.61 and 0.48 inches being preferable. The cylindrical portion 18 of the member 12 may, typically, be $\frac{5}{8}$ inches in diameter and the bore 28 may be of a size to receive a $\frac{1}{4}$-20 bolt. The overall length of the male member 12 may be 1.72 inches and the lateral surface area of the frusto conical portion may be in the range of from 1.75 to 3.0 square inches.

Having described in some detail the construction of the male portion 12 of the connector 10, attention will now be given to the female element 14 of the connector 10. The female element comprises a generally cylindrical member 36 of a first diameter which is integrally formed with a polygonal segment 38 of a larger diameter so as to define a shoulder of flange portion 40 at one end. The cylindrical portion 36 is threaded over its entire length so as to receive a clamping nut 42 thereon. Diametrically opposed flat portions 44 and 46 are formed proximate the other end of the cylindrical segment 36 and a threaded bore 48 extends inwardly from that other end in a generally concentric fashion.

The threaded bore 48 is adapted to receive a bolt 50 therein so as to hold an apertured lug 52 crimped to a further conductor 54 in intimate electrical contact with the end surface of the female connector member 14.

Formed concentrically within the body portion of the connector element 14 and connected to the bore 48 is a counterbore 56 which is cylindrical and of a predetermined length. Extending inwardly from the other end of the connector toward the counterbore 56 is a smoothly tapered bore 58 which joins to the cylindrical bore 56.

In the connector of the present invention, the body of the female element 14 may typically be 2 inches in length and the cylindrical portion 38 thereof may be $1\frac{1}{4}$ inches in diameter. The tapered bore 58 is dimensioned so as to provide an interference fit with the portion 16 of the male connector element, and for the preferred size set out above, may have a diameter of 0.625 inches at the rightmost end of the connector as viewed in the drawings and may continuously taper inwardly over its length to a diameter of 0.481 inches, that being the diameter of the cylindrical counterbore 56.

Like the male member 12, the female member 14 may be formed from a solid piece of copper and, if desired, the mating surfaces of the male member and the female member may be plated with gold or other suitable contact material exhibiting superior electrical conductivity and resistance to oxidation. However, it has been found that copper-to-copper contact provides excellent performance by itself.

Where it is desired to mount the connector of the present invention on a conductive chassis or panel, an aperture is first drilled through the panel 60 as at 62 and a first grommet 64 is slipped over the threaded portion 36 of the female member. The grommet 64 has an annular recess 66 formed on a face thereof with an inner radius slightly less than the radius of the hole 62 so that a portion thereof can fit into the aperture 62 and maintain separation between the conductive body of the female connector and the chassis itself. Likewise, a second, identical grommet 68 is fitted over the threaded portion 36 of the female connector and its annular recess 70 appropriately engages the edge of the aperture through the panel 60 so as to hold the conductive connector body 36 out of electrical contact with the conductive panel 60 through which it passes. The nut 42, when tightened down against the grommet 68, securely holds the female connector member 14 in position on the panel 60.

The frusto conical portion 16 of the male connector element 12 is dimensioned so as to provide an interference-fit with the corresponding tapered bore formed in the female connector body 14. By inserting the tapered male portion within the correspondingly tapered bore and by applying forces to opposed ends of the male and female connector member, a firm electrical contact and mechanical coupling of the parts is obtained. To facilitate later separation of the male and female connector parts, wrenches may be fitted onto the flats 24 and 26 on the male portion and to the flats 44 and 46 on the female portion. By turning these parts relative to one another, the male portion can be readily removed from the female portion.

By including the cylindrical recess 20 between the tapered portion 16 of the male member and the integrally formed cylindrical portion 18 thereof, and by having the tapered portion 58 of the female receptacle being of a greater overall length than the frusto conical portion of the male pin, any wear caused by repeated insertions and removals of the mating parts is compensated for and will not result in a loose-fitting coupling. Also, the recess 20 provides a convenient location for prying the connector halves apart with a screwdriver tip or the like.

Not only is the area of contact important to proper functioning of the connector of the present invention in audio environments, but also, the connector must possess a sufficient mass to preclude vibration of the mating surfaces and the attendant generation of noise and distortion. With the connector elements of the present invention joined, the combined weight thereof, without the bolts, may be in the range of from 4 ounces to 10 ounces. The inertia presented by this massive connector effectively precludes sound frequencies above about 4 Hz from producing resonance. It has been found that the use of special gold plated, tempered steel screws of a predetermined length (typically from one-half to three-sixteenths inch) and size to ensure sufficient clamping force with the plated lead lugs at each end, provides a low-loss, high conductivity attachment at all frequencies.

The present invention has been described herein in considerable detail, in order to comply with the Patent Statutes and to provide those skilled in the art with information needed to apply the novel principles, and to construct and use such specialized components as are required. However, it is to be understood that the invention can be carried out by specifically different equipment and devices, and that various modifications, both as to equipment details and operating procedures can be effected without departing from the scope of the invention itself.

What is claimed is:

1. A separable electrical connector for joining at least two components of a high fidelity audio system to one another, comprising:

(a) a first connector member of a first predetermined mass having a solid, frusto-conical portion of a predetermined length integrally joined at its larger base with a coaxial cylindrical portion of a lesser diameter than said larger base of said frusto-conical portion, said cylindrical portion having a coaxial threaded bore extending inward from one end thereof;

(b) a second connector member of a second predetermined mass comprising a first generally cylindrical portion having a tapered bore extending inwardly from one end thereof for a predetermined distance greater than said predetermined length and terminating internally in a second cylindrical bore of a diameter equal to the diameter of the smallest diameter of said tapered bore, said tapered bore being dimensioned to receive the entirety of said frusto-conical portion of said first connector member therein with a predetermined interference fit, said cylindrical portion of said second connector member having a threaded bore extending inwardly from the other end thereof; and (c) fastener means insertable into said threaded bores in said first and second connector members for connecting electrical wires respectively associated with said two components to said first and second connector members, the combined mass of said first connector member and said second connector member precluding resonance at sound frequencies above about 4 Hz.

2. The separable electrical connector as in claim 1 and further including flat areas formed on diametrically opposed surfaces of said cylindrical portions of said first and second connector members for facilitating uncoupling of intercoupled first and second connector members with wrenches.

3. Apparatus as in claim 1 wherein said first and second connector members are formed from copper, said frusto conical portion of said first connector member having a lateral surface area in the range of from 1.75 to 3.0 square inches and wherein the combined weight of said first and second connector members is in the range of from 4 ounces to 10 ounces.

4. The electrical connector as in claim 1 wherein the outer surface of said cylindrical portion of said second connector member is threaded to receive a threaded clamping nut.

5. The electrical connector as in claim 4 and further including first and second insulating toroidal washers having a central opening of a diameter slightly larger than the diameter of said generally cylindrical portion of said second connector member, said washers being fitted over said cylindrical portion of said second connector member for isolating said second connector member from a conductive panel.

* * * * *